US008752934B2

(12) United States Patent
Bernard

(10) Patent No.: US 8,752,934 B2
(45) Date of Patent: Jun. 17, 2014

(54) WIPING DEVICE FOR AN INK JET FRANKING MACHINE

(71) Applicant: Neopost Technologies, Bagneux (FR)

(72) Inventor: Dominique Bernard, Massy (FR)

(73) Assignee: Neopost Technologies, Bagneux (FR)

( * ) Notice: Subject to any disclaimer, the term of this patent is extended or adjusted under 35 U.S.C. 154(b) by 0 days.

(21) Appl. No.: 13/749,249

(22) Filed: Jan. 24, 2013

(65) Prior Publication Data

US 2013/0187979 A1 Jul. 25, 2013

(30) Foreign Application Priority Data

Jan. 25, 2012 (EP) ..... 12305089

(51) Int. Cl.
*B41J 2/165* (2006.01)

(52) U.S. Cl.
USPC ..... 347/33; 347/32

(58) Field of Classification Search
USPC ..... 347/32, 33
See application file for complete search history.

(56) References Cited

U.S. PATENT DOCUMENTS 4,673,303 A * 6/1987 Sansone et al. ..... 347/103
4,829,318 A * 5/1989 Racicot et al. ..... 347/33
6,151,048 A * 11/2000 Shiozaki ..... 347/55
6,511,155 B1 1/2003 Fassler et al.
2003/0063154 A1 4/2003 Goto
2005/0062797 A1* 3/2005 Kachi ..... 347/33
2005/0168521 A1* 8/2005 Suzuki et al. ..... 347/33
2008/0158291 A1* 7/2008 Satake ..... 347/33
2008/0316252 A1 12/2008 Na et al.
2010/0079539 A1* 4/2010 Inoue ..... 347/33
2011/0279530 A1* 11/2011 Love et al. ..... 347/33

OTHER PUBLICATIONS

European Search Report of EP 12 30 5089 dated May 10, 2012.

* cited by examiner

*Primary Examiner* — Stephen Meier
*Assistant Examiner* — Alexander D Shenderov
(74) *Attorney, Agent, or Firm* — Sughrue Mion, PLLC

(57) ABSTRACT

A wiping device (20) for cleaning outer surfaces of at least one row of ejection nozzles in at least one print head (4*a*, 4*b*) of an ink jet printing module (2) of a franking machine when the module is moving above the wiping device in first and second directions (X, Y), comprising two wiping rollers (26, 28) located one behind the other in the first direction and adapted to rotate in opposite directions around respective fixed shafts (30, 32), the two wiping rollers being permanently dampened in contact with a cleaning fluid (24) contained inside a container (22); and the two wiping rollers are adapted via a one-way bearing (34, 36) to remain stationary alternatively, one during the moving of the module in the first direction and the other during the moving of the module in the second direction.

10 Claims, 2 Drawing Sheets

WIPING DEVICE FOR AN INK JET FRANKING MACHINE

FIELD OF THE INVENTION

The present invention relates to the field of mail handling, and more particularly to a cleaning device of a franking machine that intermittently wipes the ejection surfaces of the ink jet nozzles of a print head.

BACKGROUND OF THE INVENTION

Service stations are known in the field of ink jet franking machines for cleaning and capping a print head at a location beyond a printing station. In intervals between printing operations, the print head is moved beyond the printing station into the service station to be wiped or capped or both.

Generally the service station comprises a carriage that is movable transversally to the print head's path so as to bring the wiping device or the capping apparatus into engagement with the print head.

In U.S. Pat. No. 5,880,755 is disclosed a cleaning device for cleaning the outer surfaces of a row of ejection nozzles integrated in at least one print module of an ink jet print head of a postage meter having a base including a cleaning member for wiping the ink ejection surfaces, the cleaning member being mounted on a support member which is movable, by actuating a drive member which is linked to a connecting-rod and crank system, between a first position in which the cleaning member is remote from the print module and a second position in which the cleaning member has wiped the outer surfaces of the ejection nozzles. The cleaning member is mounted on one end of a sweeping hinged lever and includes a compensating support member, having respective springs, each carrying a set of independent wiping brushes, in order to transform the initial circular movement of the support member into a rectilinear movement of the brushes in contact with the ejection surfaces of the print module.

U.S. Pat. No. 6,464,326 relates to an apparatus for cleaning the nozzles of an ink jet cartridge that is mounted upon the carriage of a small point of sale printer. The carriage is arranged to carry one or more ink cartridges over a reciprocal path of travel through a printing station. The printer contains a drive roller mounted upon a shaft for advancing a substrate through the printing station. A rotor is journalled for free rotation on the shaft adjacent to one end of the drive roller. A rocker arm connects the rotor to a solenoid which when energized moves the rotor from an inoperative position into an operative position. A wiper blade is mounted upon the rotor which is adapted to wipe the nozzles on the ink cartridge when the rotor is in the operative position and to retract the blade out of contact with the nozzles when the rotor is moved into the inoperative position.

It is also known by U.S. Pat. No. 7,182,428 a device for cleaning the ink ejection nozzles of an inkjet printer head of a mail handling machine, comprising, on the one hand, a scraping means arranged in a path of travel of the mail items opposite the ink ejection nozzles and actuated by a mail item as it advances beneath the printer head, and, on the other hand, a means for cleaning this scraping means. Advantageously, the scraping means is articulated between a position of scraping in which the scraping means is arranged in the path of travel of the mail items, and a position of rest in which the scraping means is withdrawn from this path of travel.

Though the cleaning devices disclosed above could prove rather satisfactory under standard operating conditions, they do not prevent the print heads and their environment as well to get dirtier and dirtier with the unavoidable accumulation of ink particles over time or under industrial conditions.

OBJECT AND SUMMARY OF THE INVENTION

Considering that the quality of the printed postage indicia is of utmost importance as the imprint represents a monetary value, and a critical data element to be scanned, it is therefore an object of the invention to propose a wiping device for efficiently and periodically cleaning the ink jet nozzles of the print head of a franking machine. Another object of the invention is to provide such a device that mainly aims at improving the cleaning of the print heads with a wiping device which is as simple and efficient as possible. Another object of the invention is to provide such a device that remains efficient and clean over a long operating period.

These objects are achieved by a wiping device for cleaning outer surfaces of at least one row of ejection nozzles in at least one print head of an ink jet printing module of a franking machine when said module is moving above the wiping device in first and second directions, characterized in that said wiping device comprises:

two wiping rollers located one behind the other in said first direction and adapted to rotate in opposite directions around respective fixed shafts, said two wiping rollers being permanently dampened in contact with a cleaning fluid contained inside a container; and the two wiping rollers are adapted via a one-way bearing to remain stationary alternatively, one during the moving of said module in said first direction and the other during the moving of said module in said second direction.

Thus this periodic cleaning systematically wipes more often the ejection nozzles on the fly when the print module leaves and returns to the capping location.

According to another major feature, the cleaning fluid is formed of a polyether compound such as the polyethylene glycol (PEG).

The use of this kind of cleaning fluid really improves the efficiency of the wiping for limiting the pollution of the print heads and their environment.

According to another major feature, fixed brushes are mounted in the container for cleaning the wiping rollers when these latter rotate.

The wiping of the ejection nozzles becomes even more efficient as the cleaning rollers are themselves maintained as clean as possible.

Preferably, a sensor detects the low level of the cleaning fluid for prompting a filling-up of the container and each wiping roller can be made of foam or of felt.

Advantageously, the diameter of each wiping roller is determined in such a way that this roller makes a complete revolution after at least one move of the print module and each wiping roller presents a same length so as to allow wiping the rows of ejection nozzles with a same wiping roller.

The present invention also concerns a franking machine comprising a wiping device as preceded.

BRIEF DESCRIPTION OF THE DRAWINGS

The foregoing in other objects, features and advantages of the invention will be apparent from the following more specific description of a preferred embodiment of the invention as illustrated in the accompanying drawings in which.

DETAILED DESCRIPTION OF A PREFERRED EMBODIMENT

Figure 1:
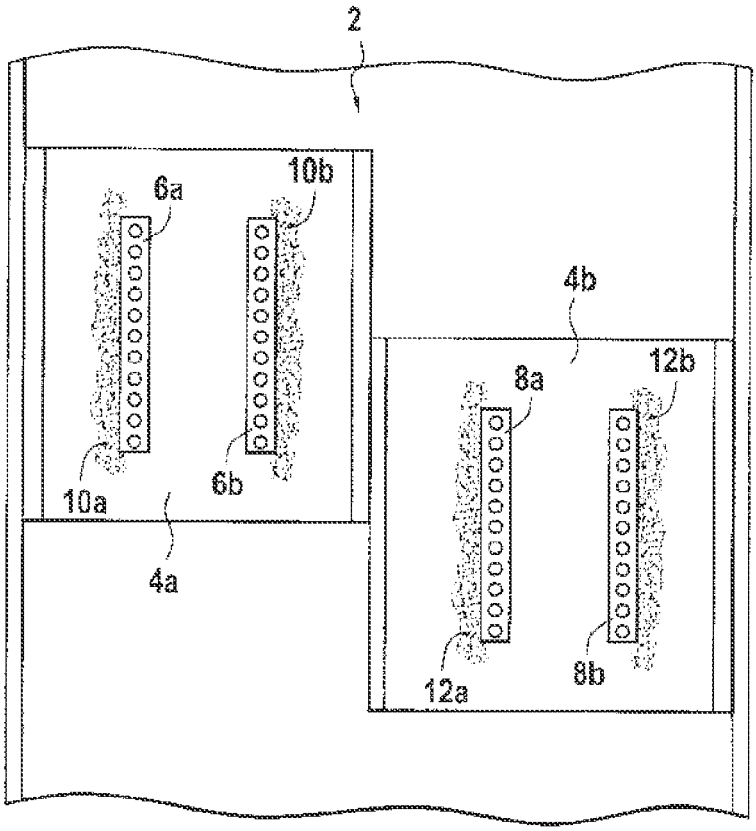
FIG. 1 is a partial perspective view of a printing module showing its two polluted print heads.

Referring to FIG. 1, a standard printing module 2 mounted on a franking machine (illustrated on FIG. 2 by its base 3 only) comprises two print heads 4*a*, 4*b* with for example their two rows 6*a*, 6*b*, 8*a*, 8*b* of ink ejections nozzles. After a multiplicity of wiping operations along the moving directions X, Y between extreme printing and capping positions, ink particles significantly pollute the print heads 4*a*, 4*b* and the wipers themselves as well which cannot remove all the ink. Ink deposits 10*a*, 10*b*, 12*a*, 12*b* are thus formed alongside the rows of nozzles. At the same time, ink particles that are projected all over the spitting and wiping areas, progressively pollute the inside of the franking machine that becomes dirtier and dirtier with other ink deposits.

Figure 2:
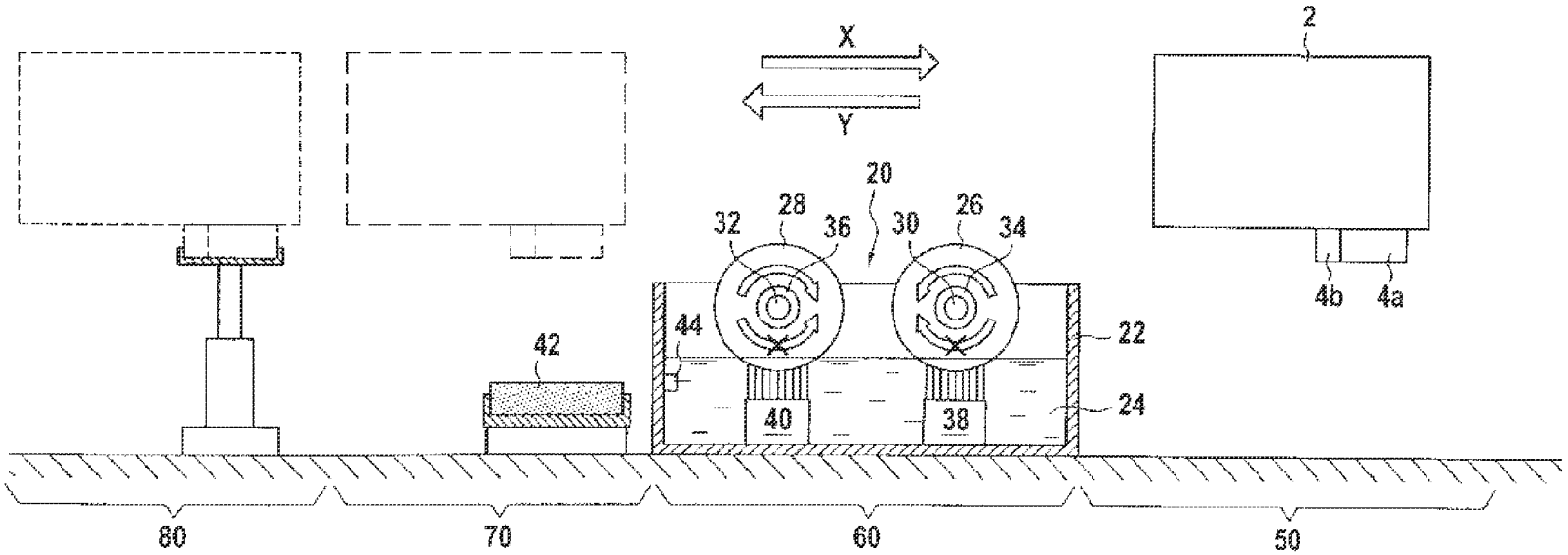
FIG. 2 is a schematic front elevation view of the printing module of a franking machine moving between a capping location and a printing position, and illustrating the wiping device of the invention.

FIG. 2 illustrates schematically the combination of the printing module 2 and a wiping device 20 according to the invention. This wiping device first comprises a container 22 filled of a cleaning fluid 24 made of a polyether compound such as the polyethylene glycol (PEG). It then comprises two wiping rollers 26, 28 located one behind the other and permanently dampened in contact with this cleaning fluid and in operation located at a wiping area 60 between printing 50 and capping 80 areas. The two wiping rollers rotate in opposite directions around respective fixed shafts 30, 32 preferably mounted on the container (a mounting on the base 3 is also possible) via a one-way bearing or clutch 34, 36 when they are driven by the print module 2 moving alternatively above the wiping rollers between these areas according to the opposite directions X, Y.

Fixed brushes 38, 40 are mounted in the container 22 for cleaning the wiping rollers when these latter rotate. These brushes are preferably immersed inside the cleaning fluid 24, fixed in the container just under the wiping rollers. As the cleaning rollers are stiff enough, made of foam or felt and soaked of the cleaning PEG fluid, they can more efficiently wipe the smudged ink nozzles.

The wiping device of the invention operates as follows. When the printing module 2 moves from the printing area 50 to the maintenance station covered by the three areas, i.e. the wiping 60, spitting 70 and capping 80 areas in the Y direction, the print heads 4*a*, 4*b* first drive smoothly the first wiping roller 26 and are secondly wiped by the second wiping roller 28 that remains stationary (motionless) thanks to the one-way bearing 36. The mentions "first" and "second" for the rollers refer to the encounter sequence of the print module with the rollers during the displacement of the print module in the Y direction.

Conversely, when the printing module 2 moves from the capping area 80 to the printing area 50 in the X direction, it stops at the spitting area 70 above an ink collection tray or sponge 42 before crossing the wiping area 60. There the print heads 4*a*, 4*b* first drive smoothly the second wiping roller 28 and are secondly wiped by the first wiping roller 26 that remains stationary thanks to the one-way bearing 34.

A sensor 44 detects a low level of the cleaning fluid for sending a warning signal and prompting the filling-up of the container. This last operation is carried out either manually or automatically.

Figure 3:
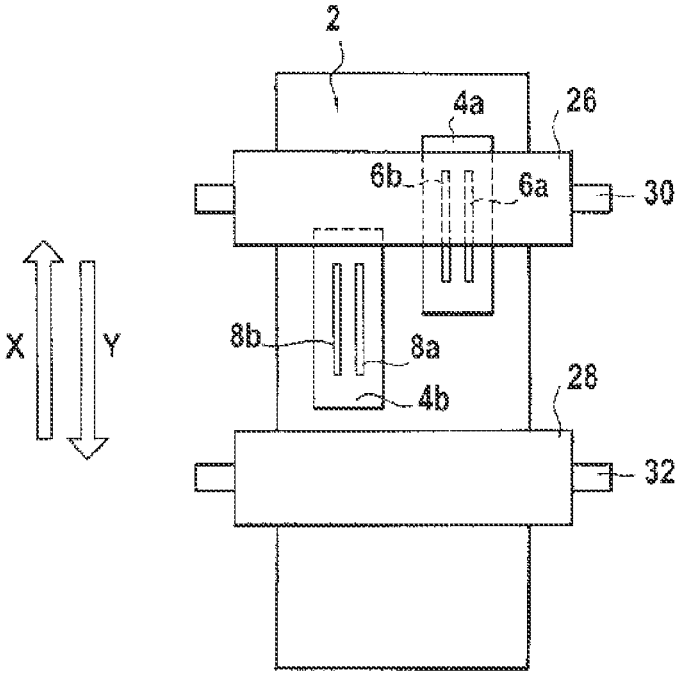
FIG. 3 is a schematic bottom plan view showing the relative locations of wiping rollers of the wiping device of the invention and print heads of the printing module.

The diameter of each wiping roller is determined in such a way that this roller makes a complete revolution after at least one move of the printing module, e.g. up to five moves. The portion of the wiping roller which is used for each wiping operation, thus changes each time for limiting the wear and soiling of the wiping roller. The fixed brushes 38, 40 allow to maintain these wiping rollers as clean as possible. As shown on FIG. 3, both wiping rollers present the same lengths so as to wipe all the rows 6*a*, 6*b*, 8*a*, 8*b* of ink ejection nozzles with each same wiping roller. Their associated fixed brushes have the same lengths too.

The invention claimed is:

1. A wiping device (20) for cleaning outer surfaces of at least one row of ejection nozzles in at least one print head (4*a*, 4*b*) of an ink jet printing module (2) of a franking machine when said module is moving above the wiping device in first and second directions (Y,X), said wiping device comprising:

two wiping rollers (26, 28) located one behind the other in said first direction (Y) and adapted to rotate in opposite directions around respective fixed shafts (30, 32), said two wiping rollers being permanently dampened in contact with a cleaning fluid (24) contained inside a container (22); and each wiping roller is operatively connected to a one-way bearing such that during the moving of said module in said first direction (Y), the first wiping roller is rotatably driven by said module while the second wiping roller remains stationary and wipes said ejection nozzles and such that during the moving of said module in said second direction (X), the second wiping roller is rotatably driven by said module while the first wiping roller remains stationary and wipes said ejection nozzles.

2. The wiping device according to claim 1, wherein the cleaning fluid is formed of a polyether compound such as the polyethylene glycol (PEG).

3. The wiping device according to claim 1, wherein fixed brushes (38, 40) are mounted in the container for cleaning the wiping rollers when these latter rotate.

4. The wiping device according to claim 3, wherein the fixed brushes are immersed inside the cleaning fluid under the wiping rollers.

5. The wiping device according to claim 1, wherein a sensor (44) detects the low level of the cleaning fluid for prompting a filling-up of the container.

6. The wiping device according to claim 1, wherein each wiping roller comprises foam.

7. The wiping device according to claim 1, wherein each wiping roller comprises felt.

8. The wiping device according to claim 1, wherein the diameter of each wiping roller is determined in such a way that a portion of the wiping roller which is used for each wiping operation is changed each time.

9. The wiping device according to claim 1, wherein each wiping roller presents a same length so as to allow wiping the rows of ejection nozzles with a same wiping roller.

10. A franking machine comprising a wiping device (20) according to claim 1.

* * * * *